US005803365A

United States Patent [19]

Ruttenberg

[11] Patent Number: 5,803,365

[45] Date of Patent: Sep. 8, 1998

[54] FLOATING ROTATING SPRINKLERS

[76] Inventor: Gideon Ruttenberg, 81-465 Date Palm Ave., Indio, Calif. 92201

[21] Appl. No.: 692,507

[22] Filed: Aug. 6, 1996

[51] Int. Cl.[6] ..... B05B 15/10

[52] U.S. Cl. ..... 239/204; 239/101; 239/570

[58] Field of Search ..... 239/99, 101, 203, 239/204, 524, 570; 137/624.14, 853, 895

[56] References Cited

U.S. PATENT DOCUMENTS

| | | | |
|---|---|---|---|
| 3,902,664 | 9/1975 | Deines | 239/102 |
| 4,535,937 | 8/1985 | Fagan et al. | 239/206 |
| 4,642,833 | 2/1987 | Stoltz et al. | 15/1.7 |
| 4,781,217 | 11/1988 | Rosenberg | 137/624.14 |
| 4,790,481 | 12/1988 | Ray et al. | 239/204 |
| 4,939,797 | 7/1990 | Goettl | 4/490 |
| 4,955,539 | 9/1990 | Ruttenberg | 239/1 |
| 5,314,116 | 5/1994 | Krauth et al. | 239/99 |
| 5,507,436 | 4/1996 | Ruttenberg | 239/1 |

*Primary Examiner*—Andres Kashnikow
*Assistant Examiner*—Lisa Ann Douglas

[57] ABSTRACT

This invention relates to pulsating rotating sprinklers which can be used for irrigation and for other applications. Such sprinklers are especially useful when their inlet is connected to an outlet from a pulsating device, which intermittently ejects pulsating fluid jets into the inlet of the sprinklers. A typical such sprinkler consists of a floating cylinder enclosed in a casing. The cylinder, which has a fluid inlet and a fluid outlet, is floating, rotating, and intermittently ejecting pulsating jets of fluid. The combination of such a floating sprinkler and the unique properties of a pulsating device can be also used for operating innovative pulsating pop-up sprinklers.

10 Claims, 7 Drawing Sheets

A-A

B-B

FLOATING ROTATING SPRINKLERS

BACKGROUND—FIELD OF THE INVENTION

This invention relates to pulsating rotating sprinklers for irrigation and the like. It also relates to innovative pulsating pop-up sprinklers which can operate without many parts which are commonly used for operating rotating pop-up sprinklers.

BACKGROUND—DESCRIPTION OF PRIOR ART

For operating any type of rotating sprinkler, three basic conditions are required, as follow:

(a) a force must be created by the fluid to ensure that the sprinkler, its nozzle, or a deflector will rotate.

(b) the force created by the fluid should be applied at a distance from the center of the sprinkler in order to create the required momentum for achieving the rotation.

(c) the momentum should be larger than the friction force created between the rotating and static parts of the sprinkler.

In the old "arm-type" sprinklers, long arms with nozzles at the ends are used for achieving the above required conditions.

In another group of sprinklers, known in the irrigation industry as micro-irrigation sprinklers, the above conditions are achieved mainly by rotating a small deflector. Such sprinklers, or mini-sprinklers, usually have limited spraying diameters and applications.

Another type of commonly used sprinkler, known as an impact sprinkler, has a deflector and a spring. Water that flows out from the nozzle hits the deflector, and the spring causes the nozzle to rotate.

All of the above-mentioned types of rotating sprinklers have a relatively large size which limits their application. When the sprinklers are not in operation, insects and other solid particles often enter their nozzle from outside, thus plugging the sprinkler.

Two types of pop-up sprinklers are commonly used in the industry:

(a) pop-up sprinklers with static sprayers; and (b) pop-up sprinklers with rotating sprinklers.

Pop-up sprinklers with static sprayers are produced by many companies. Such sprinklers can spray water efficiently to a maximum diameter of about 12 meters.

Pop-up rotating sprinklers are produced by a small number of companies such as Hunter Industries, Toro, Rainbird, and a few others. Such sprinklers consist of a small size rotating sprayer which is connected to a riser enclosed in a casing. Due to the small size of the sprayer, turbines, gears, and similar parts, are used in order to rotate the sprayer. Such pop-up rotating sprinklers consist of many parts which make the sprinklers expensive and unreliable. Such rotating pop-up sprinklers have medium (30 meter) to large spraying diameters.

Different pulsating devices can be used for converting a low continuous flow of fluid to a high intermittent pulsating flow. My U.S. patent application Ser. No. 07/345,661 now U.S. Pat. No. 4,955,539 and U.S. Pat. No. 5,507,436 describe one type of a normally-closed pulsating device (FIGS. 9*a* and 9*b*). Other Pulsating devices are described in U.S. Pat. No. 3,902,664 to Deines and U.S. Pat. No. 4,781,217 to Rosenberg. Such pulsating devices consist of different parts which are commonly enclosed in a rigid casing.

Each such device may have a different pulsating cycle time. However, between each two consecutive pulsating jets, no fluid flows out through the pulsating device outlet and, therefore, during this part of each pulsating cycle, the outlet from the pulsating device is not pressurized.

SUMMARY

This invention describes different types of rotating sprinklers including: full-circle, part-circle, and pop-up rotating sprinklers. Such sprinklers may have one or more fluid outlets (nozzles). The main part of these sprinklers is a small size cylinder which floats inside a rigid casing. The cylinder has at least one outlet hole which is located at a distance from the center of the cylinder and at a direction such that when fluid flows out from the cylinder (hole), the direction of the jet causes the cylinder to rotate on its axis. Such a rotating sprinkler is especially useful when its inlet is connected to the outlet of a pulsating device. During each pulsating cycle, when a single jet of fluid flows out from the pulsating device into the casing of the sprinkler, during a very short time (of each pulsating cycle), the cylinder floats and rotates, and the fluid than ejects through the fluid outlet from the cylinder( which is also the outlet of fluid from the sprinkler). A single jet of fluid that flows from the pulsating device into the cylinder and out through its outlet, causes the cylinder to rotate on its axis with virtually no friction. Each pulsating jet causes the cylinder to rotate in a fraction of a circle. Several such pulses will cause the sprinkler to complete a full-circle.

When the sprinkler is not in operation, the cylinder moves down into the casing and the outlet from the sprinklers is sealed inside the casing.

A simple mechanism can be used for operating part-circle floating sprinklers.

Due to its small size, the sprinkler can be used with pop-up sprinklers.

By using a pulsating device and a floating sprinkler, as described, an innovative pop-up sprinkler was developed which can operate without gears, turbines, and many other parts which are commonly used in pop-up sprinklers. A pop-up sprinkler, as described, can spray water efficiently to a diameter of 20 meters or more, and perform better than a conventional rotating pop-up sprinkler. Moreover, the pulsating floating pop-up sprinkler described in this invention can spray water to distance described above using a very low flow.

OBJECTIVES AND ADVANTAGES

Accordingly, several objects and advantages of the present invention are to provide a pulsating rotating sprinkler which:

(a) has a very small size;

(b) rotates with virtually no friction;

(c) can spray liquids at a very low flow to a large distance;

(d) can have one or more nozzles at any desired size, shape and angle;

(e) can spray fluids to a full or any part of a circle;

(f) a sprinkler that, at the end of each irrigation cycle, moves into a casing, preventing insects or any other objects from penetrating its outlets from its outside surrounding;

(g) rotates in steps at a speed and frequency that can be controlled;

(h) can be connected to an outlet of a pulsating pop-up device;

(i) can be connected to a pulsating device or become a part of the pulsating device itself;

(j) can be used for irrigating any crop;

(k) due to its small size, can be used for other applications, including dish washers, fire protection, etc.

Further objectives and advantages will become apparent from a consideration of the following description and accompanying drawings.

BRIEF DESCRIPTION OF THE DRAWINGS

FIG. 1*a* is a view of the sprinkler at the stage in which the cylinder is floating.

FIG. 1*b* is a view of the sprinkler at the stage in which the cylinder is at its highest position, ejecting liquid through its outlet.

FIG. 1*c* is a view of the sprinkler at the stage in which it is not in operation.

FIG. 1*d* is a longitudinal cross section showing the sprinkler with its cylinder at a floating stage.

FIG. 1*e* illustrates, partly in cross section, the sprinkler at the stage in which a jet of fluid flows into the sprinkler inlet and then continues to flow through the cylinder and out through its outlet.

FIG. 1*f* is a top view of the sprinkler showing the direction to which the fluid flows out from the sprinkler.

FIG. 1*g* is a top view of the sprinkler showing its rotation in response to one pulsating jet that flows into the sprinkler.

FIG. 3*a* is a view of the cylinder.

FIG. 3*b* is a top view of the top part of the cylinder.

FIG. 3*c* is a top view of the bottom part of the cylinder.

FIG. 3*d* illustrates, partly in cross section, the three parts of this cylinder.

FIG. 3*e* is a front and top view of the gate valve.

FIG. 3*f* is a top view showing the gate inside the bottom part of the cylinder.

FIG. 3*g* is a view, partly in cross section, showing the different parts of the sprinkler.

FIG. 3*h* is cross section B—B, showing the handle of the gate valve in a space with two pins, limiting its rotation, causing the gate valve to change position.

FIG. 3*i* is a top view of the sprinkler showing the direction of rotation when one of the two holes is plugged and the other is open.

FIG. 3*j* is a top view of the sprinkler showing a change of direction in rotation caused when the gate moves, thereby closing one hole and opening the other.

FIG. 3*k* is a view of the sprinkler showing the direction of its rotation when its right hole is open and the left hole is closed.

FIG. 3*l* is a view showing how the direction of rotation is changed.

FIG. 5*a* is a nomogram which illustrates the cycle time of a pulsating device which intermitently ejects pulsating jets of fluid.

FIG. 5*b* is a view, partly in cross section, showing the sprinkler during time T3, at which the cylinder is floating, moving up, and rotating.

FIG. 6*a* shows the pop-up sprinkler during operation, with its water outlet at the high level.

FIG. 6*b* shows the pop-up sprinkler when not in operation.

FIG. 7 shows in a view partly in cross section the different parts of a typical pop pulsating rotating sprinkler.

DETAILED DESCRIPTION OF THE PREFERRED EMBODIMENTS OF THIS INVENTION

Figure 1A:
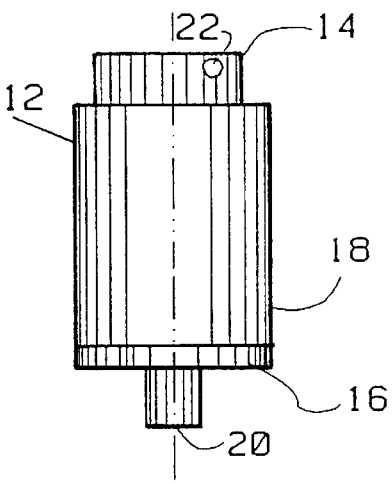
FIGS. 1*a* through 1*g* show a full-circle floating rotating sprinkler with a single spraying outlet.

FIGS. 1*a* through 1*g* show a full-circle floating rotating sprinkler. FIG. 1*a* shows a view of the sprinkler at its floating stage. Sprinkler 12 consists of three parts: Floating cylinder 14, inlet fitting 16, and casing 18. The sprinkler has fluid inlet 20 and hole 22 in cylinder 14. This hole 22 is also the fluid outlet from sprinkler 12.

Figure 1B:
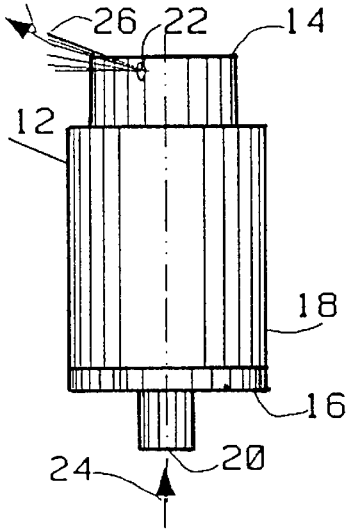

FIG. 1*b* shows in a view the sprinkler at the stage in which it is ejecting a jet of fluid. Pulsating jet 24 of fluid flows into sprinkler 12 and jet 26 flows out through hole 22.

Figure 1C:
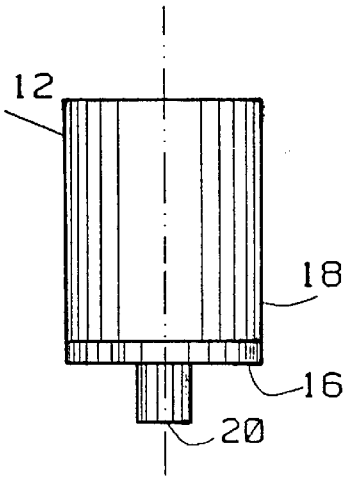

FIG. 1*c* shows the sprinkler when it is not in operation. At this stage, floating cylinder 14 moves down into casing 18, sealing its outlet 22.

Figure 1D:
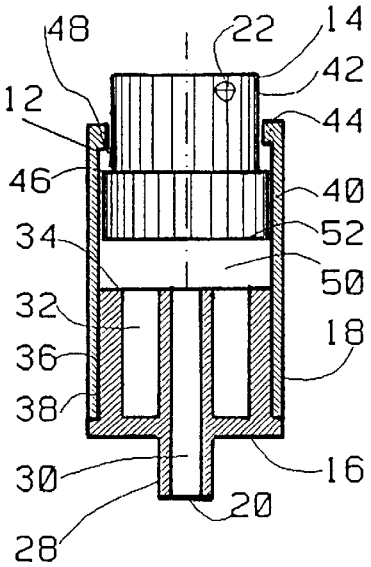

FIG. 1*d* is a view partly in cross section showing the sprinkler at its floating stage. Fluid inlet fitting 16 is formed with nipple 28, bore 30, round cavity 32, and flat top 34. Outside diameter 36 of fitting 16 is firmly connected to casing 18 around its inside diameter 38. Outside diameter 40 of cylinder 14 is smaller than inside diameter 38 of casing 18. Outside diameter 42 of cylinder 18 is smaller than inside diameter 44 of casing 18. Flat portion 46 of cylinder 14 is out of contact with flat portion 48 of casing 18. Space 50 is formed inside casing 18 and between flat top 34 of inlet fitting 16 and flat bottom 52 of cylinder 14. Cylinder 14 therefore can freely move up and down inside casing 18.

Figure 1E:
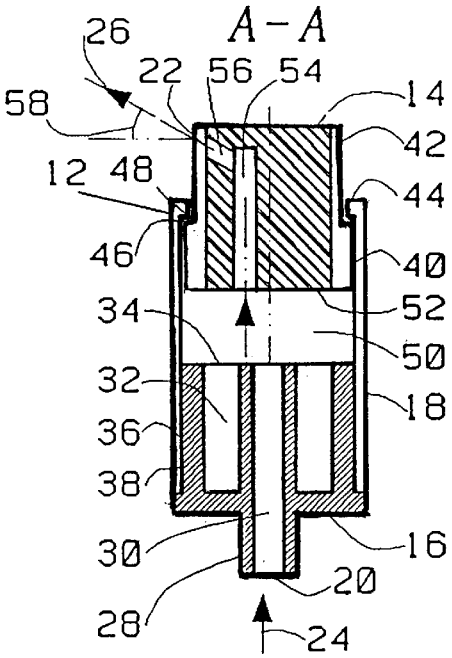

FIG. 1*e* is cross section A—A showing the path in which the fluid flows into and out of the sprinkler. Pulsating jet of fluid 24 enters sprinkler 12 through its fluid inlet 20 and then through bore 30, space 50, vertical bore 54, and bore 56 out through hole 22, which is the outlet from the sprinkler, in jet 26 at angle 58.

Figure 1F:
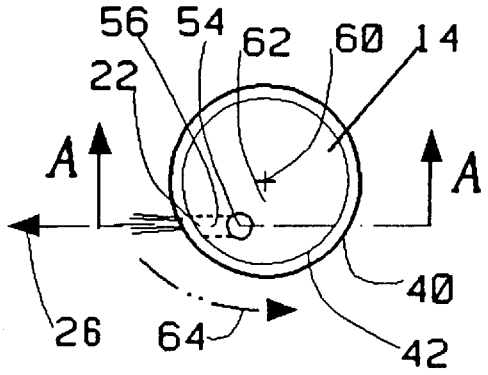

FIG. 1*f* shows the floating cylinder 14 in a top view. Floating cylinder 14 has vertical bore 54 and bore 56 which control the direction in which the fluid flows out from the sprinkler in jet 26 through hole 22. Bores 54 and 56 are located at distance 62 from center 60. As the fluid flows out from hole 22, cylinder 14 is forced to rotate in direction 64.

Figure 1G:
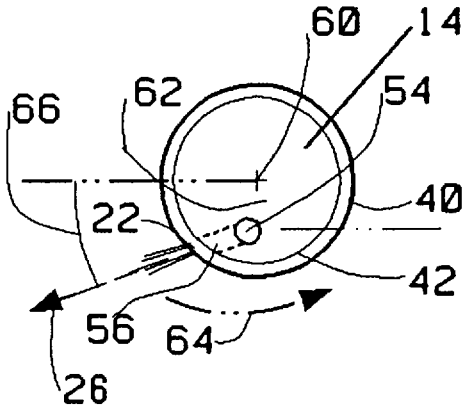

FIG. 1*g* shows floating cylinder 14 after one pulse. In response to one pulse in which jet 26 of fluid flows out from cylinder 14 through hole 22, cylinder 14 is forced to rotate in direction 64. Cylinder 14 will rotate at angle 66 during each pulsating cycle. A number of N such pulses will cause the cylinder to complete a rotation of a full-circle.

Figure 2A:
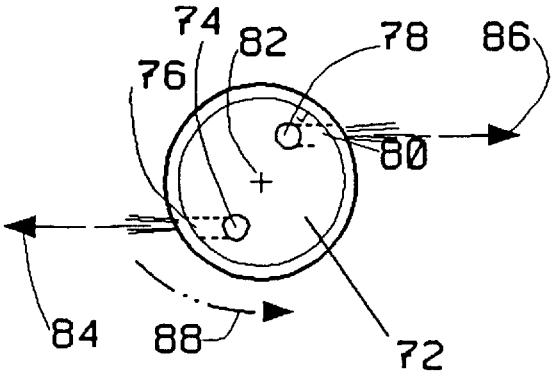
FIG. 2*a* shows in a top view a full-circle floating rotating sprinkler with two spraying outlets.

FIG. 2*a* shows in a top view a floating cylinder of a full-circle floating rotating sprinkler with two spraying outlets. Floating cylinder 72 is formed with vertical bore 74 and fluid outlet 76, located on one side of the center 82, and bore 78 and fluid outlet 80, located on the opposite side of center 82. Thus, fluid jet 84 flowing out from outlet 76, and fluid jet 86 flowing out from outlet 80, force cylinder 72 to rotate in the same direction 88. Each of outlets 76 and 80 can be formed in various shapes, sizes, and angles. Floating cylinder 72, combined with a casing and an inlet fitting as shown in FIG. 1*d*, forms a full-circle floating sprinkler with two fluid outlets.

Figure 2B:
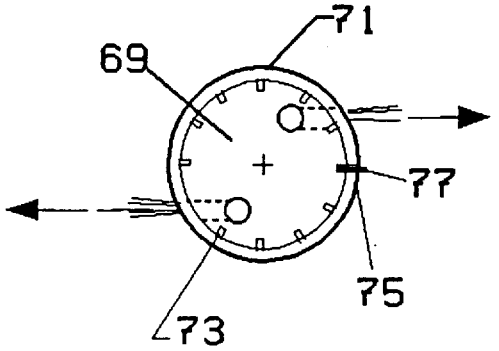
FIG. 2*b* shows in a top view a full-circle floating rotating sprinkler that can be used also as a fixed static pulsating sprayer.

FIG. 2*b* is a floating pulsating rotating sprinkler which can also operate as a fixed pulsating sprayer. Floating cylinder 69 is formed with vertical grooves 73 at its outside surface and casing 71 is formed with a horizontal groove 75. A pin 77 connecting any of grooves 73 with groove 75 is used for preventing cylinder 69 from rotating and thereby converting the pulsating rotating sprinkler to a static pulsating sprayer.

FIGS. 3*a* through 3*l* show a part-circle floating rotating sprinkler.

Figure 3A:
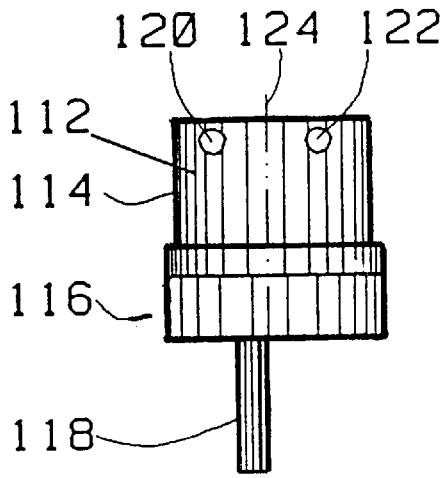
FIGS. 3*a* through 3*l* show a part-circle floating rotating sprinkler.

FIG. 3*a* shows in a front view a floating cylinder of a part-circle floating sprinkler. Floating cylinder 112 consists of top part 114, bottom part 116, and two-way gate valve 118. Top part 114 is formed with fluid outlet hole 120, located on one side of center 124, and fluid outlet hole 122, located on the other side of center 124. Top 114 and bottom 116 parts are firmly connected to each other (by cementing them together or other means) and gate 118 is located in a cavity formed in bottom part 116. Gate 118 has two positions. In one of its two positions, outlet 120 remains open while other outlet 122 remains closed. At the second position of gate 118, outlet 120 is closed and outlet 122 is opened, so that at any time only one fluid outlet remains open. The two outlets, 120 and 122, are formed for rotating cylinder 112 in opposite directions.

Figure 3D:
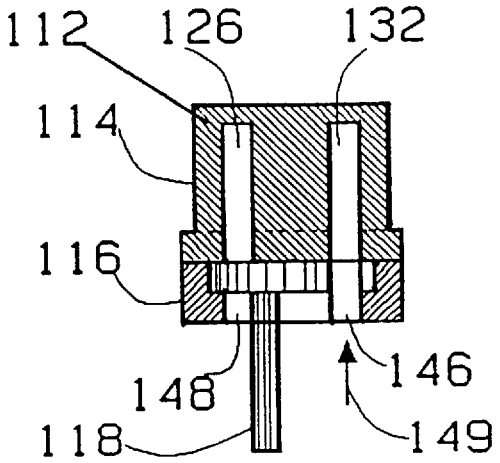
Figure 3B:
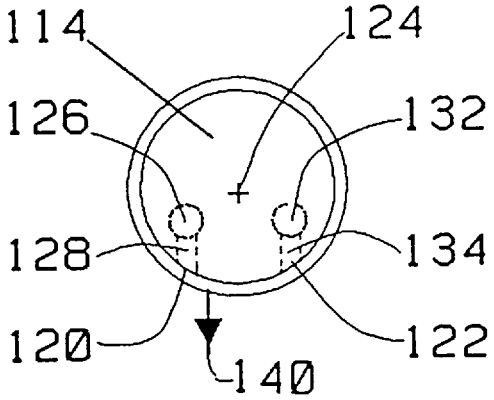

FIG. 3*b* is a top view of part 114. Top part 114 of cylinder 112 has vertical bore 126, bore 128, and fluid outlet hole 120 on one side of center 124 so that fluid jet 140 flowing out from hole 120 forces cylinder 112 to rotate clockwise. Vertical bore 132, bore 134, and fluid outlet hole 122 are formed on the other side of center 124 so that a jet flowing out from hole 122 will apply a force and rotate cylinder 112 counterclockwise.

Figure 3E:
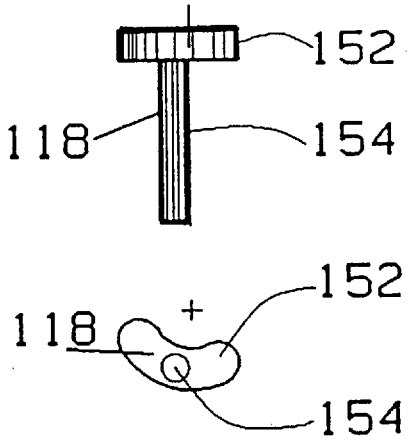
Figure 3C:
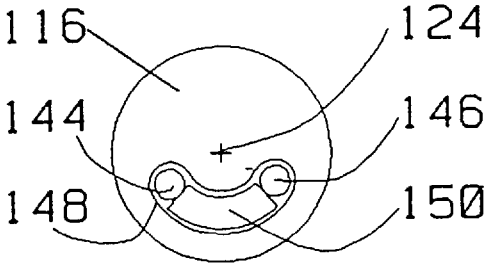

FIG. 3*c* is a top view of part 116. Bottom part 116 is formed with hole 144, which is located in the same location as vertical hole 126 in relation to center 124. Hole 146 is likewise located at the same location as vertical hole 132 in relation to center 124. Bottom part 116 is formed with cavity 148 and slot 150.

FIG. 3*d* shows in a view partly in cross section the three parts of the floating cylinder. Gate 118 is at a position in which vertical hole 126 is closed and jet 149 of a fluid flows through hole 146 into vertical bore 132.

FIG. 3*e* shows the gate valve in a top view. Top part 152 of gate 118 is flat and has a shape similar to that of cavity 148, though slightly shorter. Rod 154 has an outside diameter smaller than the width of slot 150 and can move freely inside slot 150 together with flat part 152 of gate 118 that moves inside cavity 148.

Figure 3F:
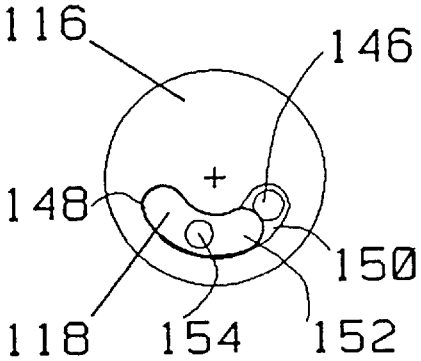

FIG. 3*f* is a top view of part 116 with gate 118 inside the cavity. Gate 118 is located at the left side of cavity 148 plugging hole 148 while hole 146 remains open.

Figure 3G:
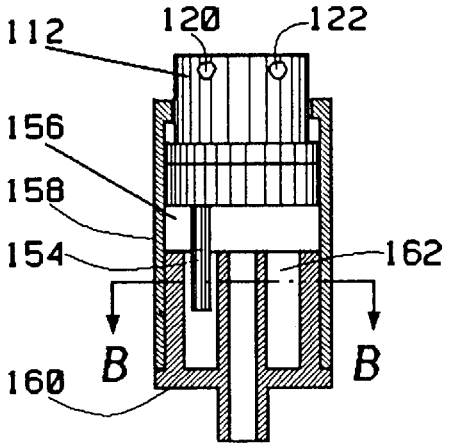

FIG. 3*g* is a view partly in cross section showing the different parts of a part-circle rotating floating sprinkler. Part-circle floating sprinkler 156 consists of floating cylinder 112, casing 158, and inlet fitting 160. Rod 154 of gate 118 is located inside round cavity 162 of inlet fitting 160. Cylinder 112 has two fluid outlets, 120 and 122. During operation, one of the cylinders remains open while the other is closed.

Figure 3H:
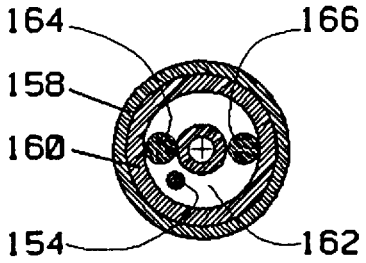

FIG. 3*h* is horizontal cross section B—B showing the pins which control the position of the gate valve. Pins 164 and 166 are fixed inside round cavity 162 of inlet fitting 160. Rod 154 of gate 118 is inserted into cavity 162 between controlling pins 164 166. When hole 144 is open and hole 146 is plugged, floating cylinder 112 can move clockwise until rod 154 is stopped by pin 164. This forces rod 154 and gate valve 118 to move to an opposite position, plugging hole 144 and opening hole 146, thereby causing the floating cylinder to change its rotation direction.

Figure 3I:
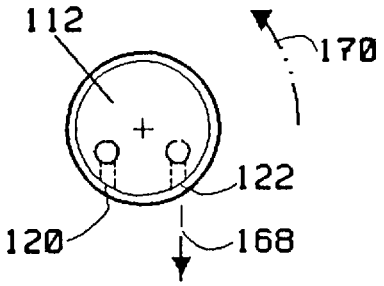

FIG. 3*i* is a top view of the floating cylinder showing it at the stage at which it is rotating counterclockwise. Hole 120 is plugged and fluid flows in jet 168 out through hole 122 forcing cylinder 112 to rotate counterclockwise in direction 170.

Figure 3J:
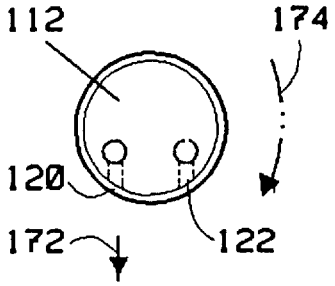

FIG. 3*j* is a top view of the floating cylinder showing it at the stage at which it rotates clockwise. Hole 122 is plugged and fluid flows in jet 172 out through hole 120 forcing cylinder 112 to rotate clockwise in direction 174.

Figure 3K:
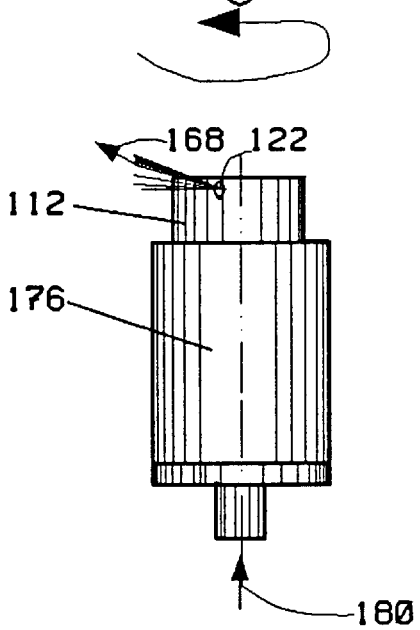

FIG. 3*k* is a front view showing the part-circle sprinkler at the stage in which it is rotating counterclockwise. Jet 180 of fluid that enters sprinkler 176 when outlet hole 120 is plugged flows out from cylinder 112 in jet 168 through its outlet hole 122 forcing cylinder 112 to rotate counterclockwise.

Figure 3L:
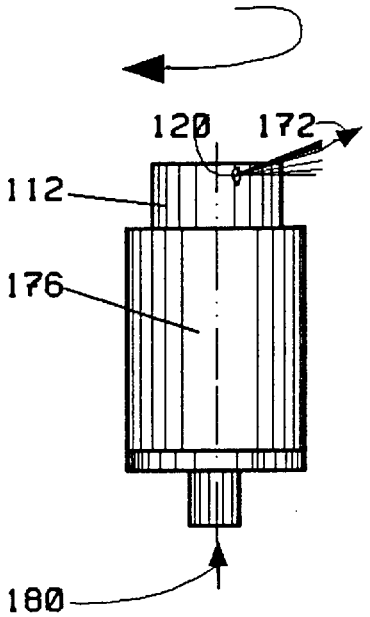

FIG. 3*l* is a front view showing the part-circle sprinkler at the stage in which it is rotating clockwise. Jet 180 of fluid that enters sprinkler 178 when outlet hole 122 is plugged flows out from cylinder 112 in jet 172 through its outlet hole 120 forcing cylinder 112 to rotate clockwise.

Figure 4:
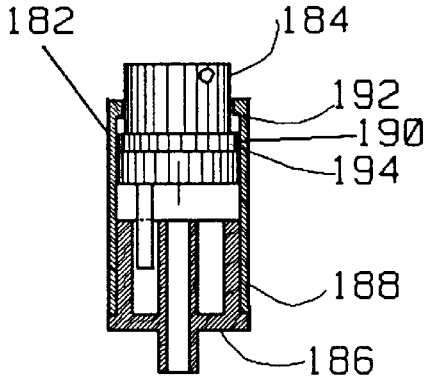
FIG. 4 shows the floating rotating cylinder of a sprinkler with a rubber "O" ring that is used to eliminate noise during operation.

FIG. 4 shows in a view partly in cross section rotating floating sprinklers with an "O" ring. Sprinkler 182 consists of floating cylinder 184, inlet fitting 186, and casing 188. An "O" ring, or rubber washer 190, located between top flat portion 194 of cylinder 184 and flat bottom 192 of casing 188 is used for eliminating or reducing the noise created during the operation of the sprinkler. This noise may be created when flat rigid top 194 of cylinder 184 hits rigid flat portion 192 of casing 188 at a high frequency.

Figure 5A:
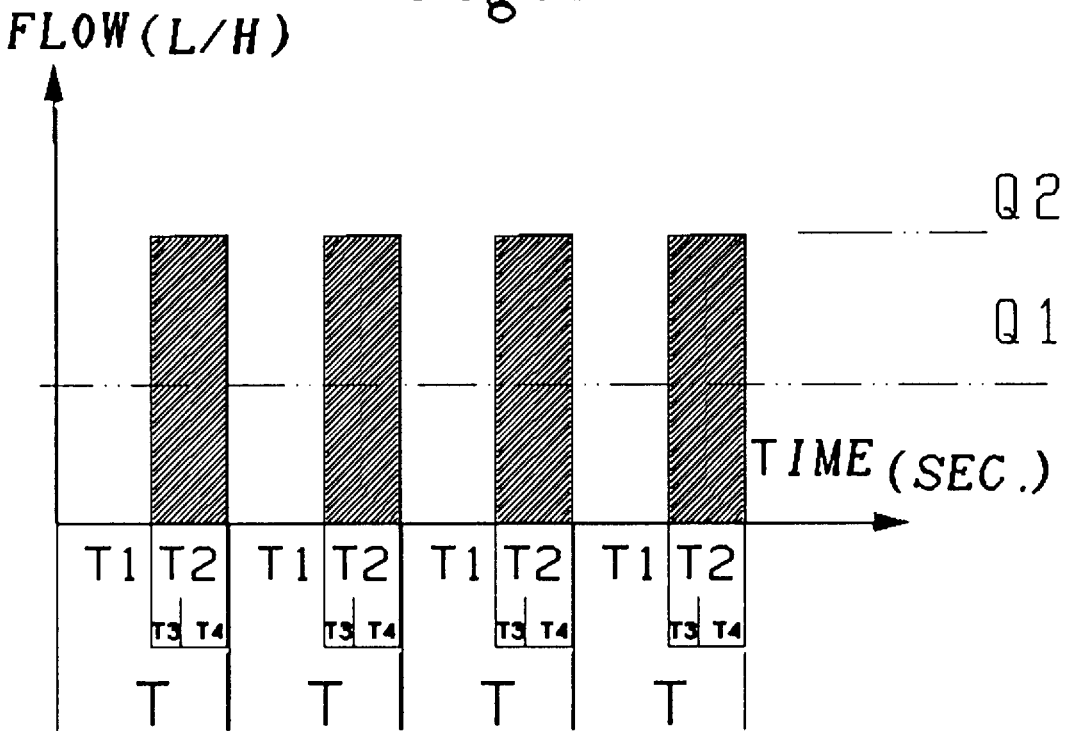
FIGS. 5*a* and 5*b* show the cycle time of a floating rotating sprinkler.

FIG. 5*a* is a nomogram which illustrates a pulsating cycle time of a pulsating device in which a low continuous fluid flow is converted to a high intermittent pulsating flow. Continuous low flow Q1 entering a pulsating device through its inlet is ejected at high intermittent pulsating flow Q2 through the outlet from the pulsating device. Pulsating cycle time T consists of time T1, which is the intermission time between each two consecutive pulses, and time T2 during which the fluid ejects through the outlet of the pulsating device. (Note: T=T1+T2)

Figure 5B:
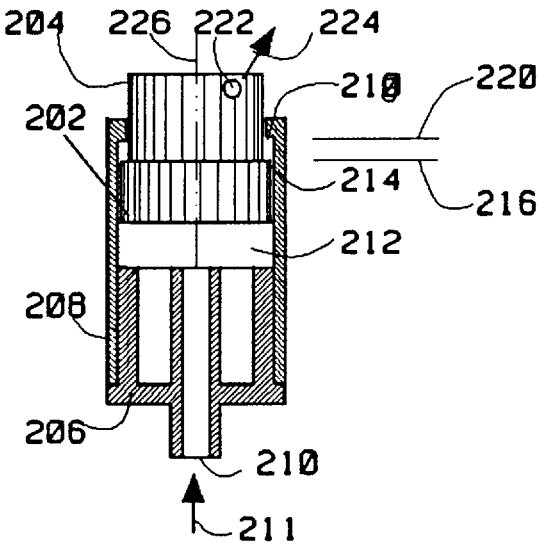

FIG. 5*b* is a view partly in cross section which shows a typical floating rotating sprinkler at its rotating stage. Sprinkler 202 consists of cylinder 204, fluid inlet fitting 206, and casing 208. When sprinkler 202 is connected by its inlet fitting 206 to the outlet from a pulsating device (not shown) then:

(a) during each intermission, which lasts time T1 in each pulsating cycle time T, no fluid enters from the pulsating device outlet through fluid inlet 210 into sprinkler 202. Space 212 of sprinkler 202 is not pressurized and cylinder 204 can float inside casing 208.

(b) at the beginning of ejection time T2 of each pulsating cycle time T, flat portion 214 of cylinder 204 is located at elevation 216 and distance H from flat portion 218 at elevation 220.

(c) during time T3 of each ejection time T2, pressurized jet 211 of fluid that enters space 212 causes floating cylinder 204 to first move up a distance H. At this stage, as flat portion 214 of cylinder 204 moves from elevation 216 to elevation 220, cylinder 204 is out of contact with any other part of sprinkler 202. Fluid that flows out from space 212 through cylinder 204, out through outlet hole 222 in jet 224, causes cylinder 204 to rotate without any friction around center 226.

(d) during time T4, space 212 is pressurized and flat portion 214 of cylinder 204 is forced against flat portion 218 of casing 208. Cylinder 204 can no longer move and the fluid flows out from sprinkler 202 through its outlet hole 222.

Figure 6A:
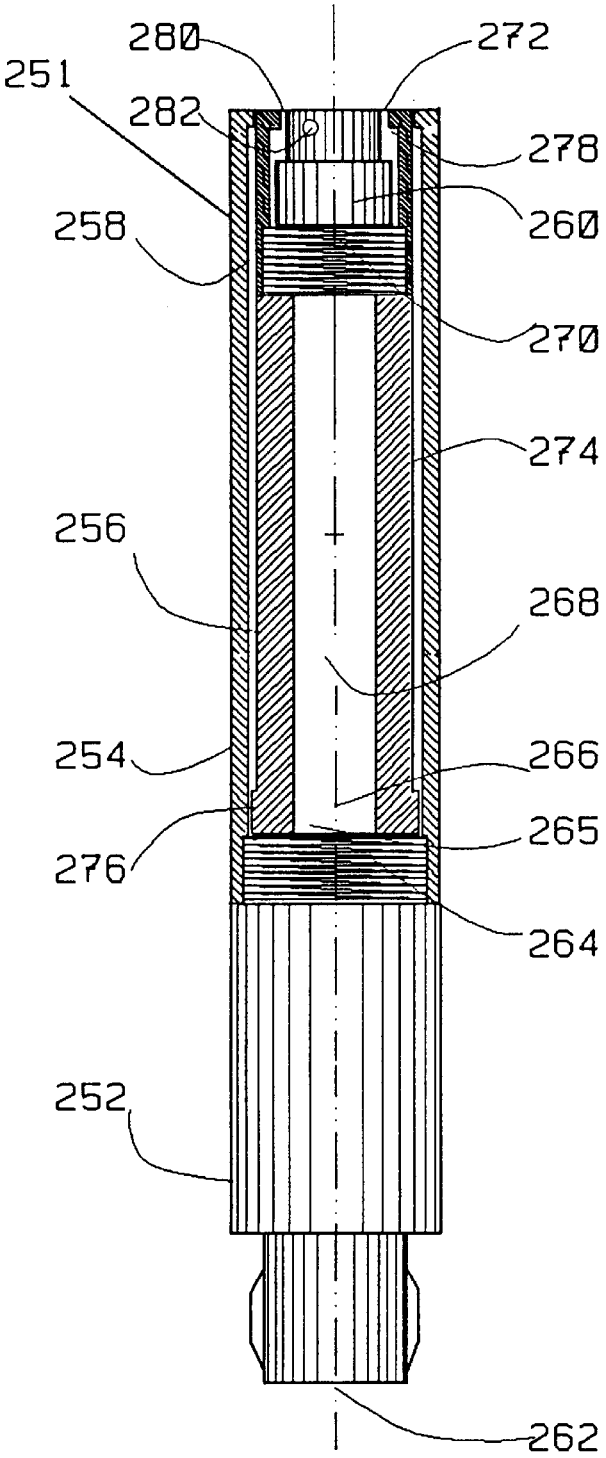
FIGS. 6*a* and 6*b* show innovative pop-up sprinklers.
Figure 6A:
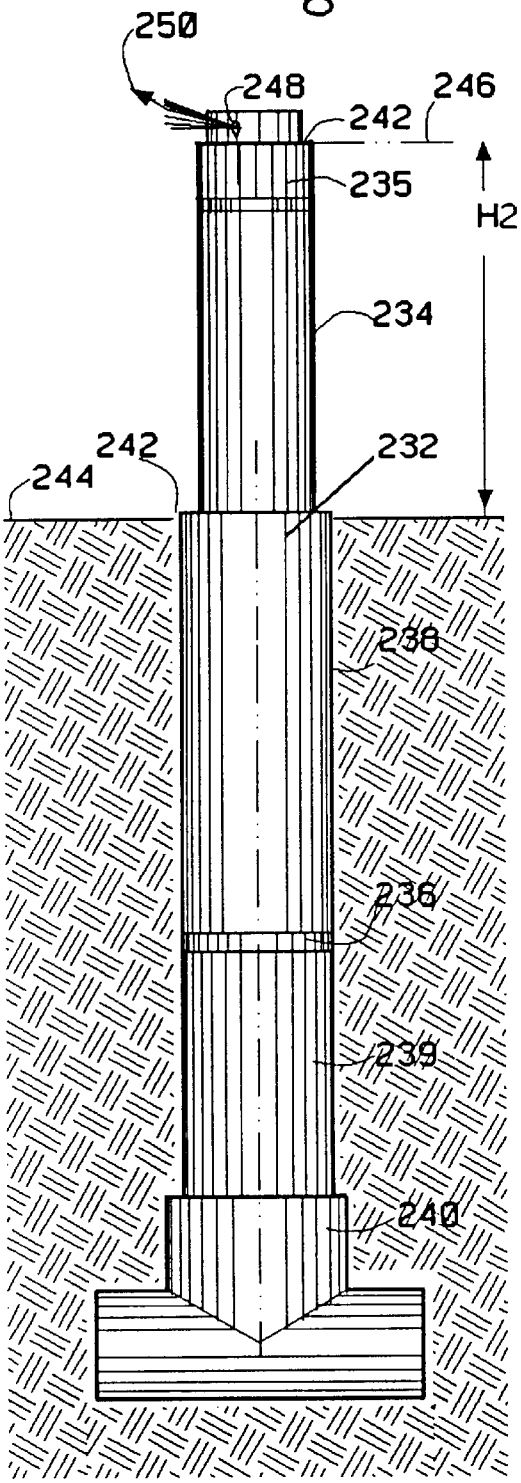
Figure 6B:
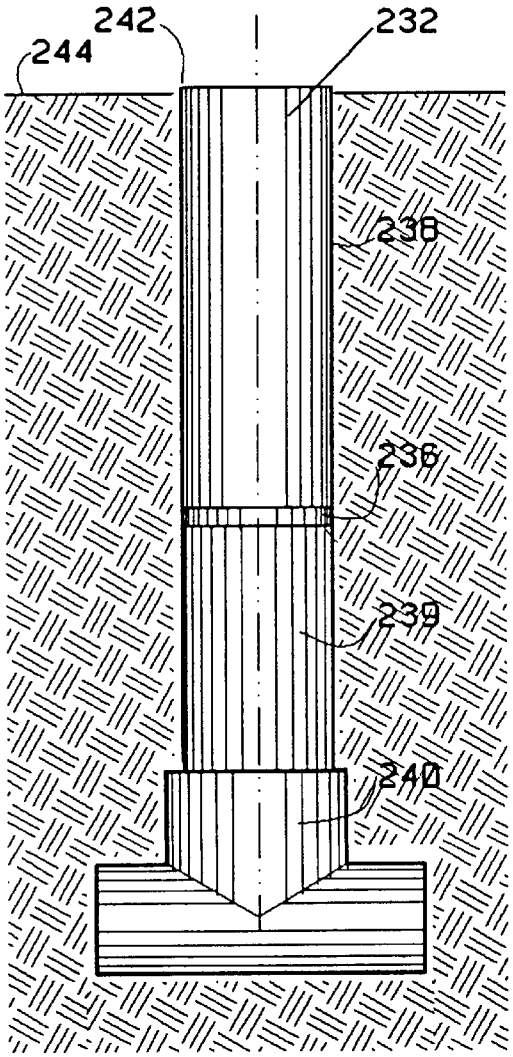

FIG. 6*a* and 6*b* show in a view partly in cross section a pop-up floating rotating sprinkler. Pop-up rotating sprinkler 232 consists of floating rotating sprinkler 235, casing 238, riser 234, and pulsating device 239. Pop-up sprinkler 232 is connected through its inlet fitting 236 to the outlet from pulsating device 239. Floating rotating Sprinkler 235 is connected by its inlet fitting to the outlet of riser 234. Pulsating device 239 is connected at its inlet to a source of pressurized water by fitting 240, to an irrigation water supply system. Pop-up sprinkler 232 is installed with top 242 of casing 238 located close to ground level 244.

FIG. 6*a* shows the pop-up sprinkler during operation. At this stage, top 242 of sprinkler 232 is at elevation 246 at distance H2 from ground level 244 and water flows out from sprinkler 232 through its outlet hole 248 in jet 250.

FIG. 6*b* shows the pop-up sprinkler when it is not in operation. Riser 234 and floating sprinkler 235 move down into casing 238, sealing outlet 248.

FIG. 7 shows in a view partly in cross section the different parts of a typical pop-up sprinkler described in this invention. Pop-up sprinkler 251 comprises pulsating device 252, pop-up casing 254, pop-up riser 256, and casing 258 for floating cylinder 260. Pulsating device 252 has water inlet 262 which is also the water inlet to pop-up sprinkler 251. Pulsating device 252 has water outlet 264 which is in fluid communication with inlet 265 to casing 254. Riser 256 has water inlet 266, bore 268 and water outlet 270. Casing 254 is connected to pulsating device 252 by threading its inside diameter to the outside diameter at outlet 264 from pulsating device 252. Cylinder casing 258 is connected by threads to the outlet 270 from riser 258. Casing 254 has a riser outlet 272 that is slightly larger than outside diameter 274 of riser 256 and cylinder casing 258. Shoulder 276 is larger than outlet 272.

Operation: FIG. 7

Pressurized water flows into pulsating device 252 through its inlet 262. When the pressure P of water at inlet 262 is higher than the preset normally-closed pressure of pulsating device 252, the water flows out from pulsating device 252 into pop-up casing 254, causing pop-up riser 256 to move up inside casing 254, and out from casing 254 through riser outlet 272. The upward movement of riser 256 will stop when shoulder 276 reaches top 278 of casing 254. Flat shoulder 276 is pressed against flat top 278 of casing 254 sealing space 280 in riser outlet 272 and around riser 256. At this stage casing 254 is full of water and pressurized. Each additional jet of water that flows out from pulsating device outlet 265 into casing 254 flows through riser inlet 266, bore 268 and outlet 270, into cylinder casing 258. In response, cylinder 260 moves up inside cylinder casing 258, floats and rotates until cylinder casing 258 becomes full of pressurized water. The jet of water then continues to flow through cylinder 260 and out through water outlet 282 from floating cylinder 260. Between two consecutive jets that are intermittently ejected from pulsating device 252, the pressure inside cylinder casing 258 drops and cylinder 260 moves down to its floating position. Each single jet causes cylinder 260 to rotate in a fraction of an angle. As water continues to flow out from pulsating device 252, cylinder 260 continues to rotate.

When the pressure at water inlet 262 drops and becomes lower than the preset normally-closed pressure of the pulsating device, the pulsating device closes itself, preventing water from flowing out through its outlet 264. Outlet 264 and inlet 265 to casing 254 are not pressurized, thus the weight of riser 256 or a spring (not shown) causes riser 256 to move down to its low position inside casing 254, as shown in this drawing. A spring (not shown) can be installed inside casing 254 around riser 256 for a quicker retrieval of riser 256 into casing 254 in exactly the same manner such springs are used with any conventional pop-up sprinkler.

The pulsating device can be located at the inlet of the pop-up sprinkler as shown, or the pulsating device can be located in bore 268 inside riser 256 (not shown) and move vertically together with riser 256. Nevertheless, the innovated pop-up sprinkler may have a very small size and can spray water to a very large distance using a very low flow.

I claim:

1. A rotating pulsating floating sprinkler for irrigation comprising:

(a) a rigid round cylinder having at least one fluid inlet and at least one fluid outlet in which:
- said fluid outlet from said cylinder is in fluid communication with said fluid inlet to said cylinder
- said cylinder has a round shoulder at its bottom
- said fluid outlet of said cylinder is located at a distance from said shoulder at said bottom of said cylinder
- said fluid outlet from said cylinder is formed at a distance and direction from the center of said cylinder such that fluid that flows into said cylinder through said fluid inlet and out through said fluid outlet will create a rotation momentum for rotating said cylinder around its axis (b) a rigid round casing having:
- a fluid inlet in one side
- a flat inside top with a hole at its center, whereby the diameter of said hole is larger than the outside diameter of said cylinder and smaller than the outside diameter of said round shoulder (c) a pulsating device with a fluid inlet and a fluid outlet which intermittently ejects jets of fluid through its outlet during operation (d) a confined space formed inside said casing and said fluid outlet from said pulsating device (e) said cylinder that is inserted inside said space so that it can freely move up and down inside said space and through said round hole in said casing so that:
- at the highest position of said cylinder inside said space said shoulder of said cylinder is engaged and pressed against said flat top of said casing at the highest position of said cylinder inside said space said fluid outlet from said cylinder is located outside said casing (f) one jet of fluid which flows from said fluid outlet of said pulsating device through said fluid inlet of said casing into said confined space causes:
- said cylinder to freely move up inside said space
- said cylinder to rotate as the fluid flows into said cylinder and out through said fluid outlet of said cylinder while said cylinder floats and moves up inside said space said space to become pressurized and said cylinder to move to its highest position inside said space; then, said shoulder of said cylinder is engaged and pressed against said flat top of said casing, said fluid flows from said space through said fluid inlet of said cylinder, and ejects through said fluid outlet of said cylinder (g) between each two consecutive pulses no fluid flows out from said outlet of said pulsating device and:
the pressure of fluid inside said space drops
said round shoulder disengages itself from said flat top
said cylinder freely moves inside said space, terminating one cycle of the pulsating floating rotating sprinkler, during which said cylinder is rotated a fraction of a circle and ejects pulse of fluid (h) several such pulsating cycles cause said cylinder to complete a full round (i) when said pulsating device is not in operation, said cylinder moves down inside said space to its lowest position.

2. A rotating pulsating floating sprinkler according to claim 1 in which said fluid is water.

3. A rotating pulsating floating sprinkler according to claim 2 in which said sprinkler is used for irrigation.

4. A rotating pulsating floating sprinkler according to claim 3 in which said sprinkler can me made to rotate and spray water to any desired part of a circle.

5. A rotating pulsating floating pop-up sprinklers according to claim 4 in which said pulsating device is located inside a popping riser of said pop-up sprinkler.

6. An irrigation system according to claim 4 comprising:

(a) a source of pressurized water (b) a water-delivering and distribution system (c) rotating pulsating floating sprinkler connected to said water delivery and distribution system (d) said sprinkler operates at a relatively low flow, spraying water to a relatively large distance.

7. A rotating pulsating floating sprinkler according to claim 1 wherein said casing includes a fluid inlet fitting for connecting said sprinkler to said outlet from said pulsating device.

8. A rotating pulsating floating sprinkler according to claim 7 in which said sprinkler is a pop-up sprinkler.

9. A rotating pulsating floating sprinkler according to claim 1 wherein said cylinder is inserted inside the casing of said pulsating device.

10. A rotating pulsating floating sprinkler according to claim 1 including a bolt for locking said sprinkler and preventing it from rotating, thereby causing said fluid to flow out from said outlets of said sprinkler at any desired fixed direction.

* * * * *